US008556751B2

(12) United States Patent
Ono

(10) Patent No.: US 8,556,751 B2
(45) Date of Patent: Oct. 15, 2013

(54) GOLF BALL WITH PROJECTIONS ADJACENT DIMPLES

(75) Inventor: Takahisa Ono, Fujisawa (JP)

(73) Assignee: NIKE, Inc., Beaverton, OR (US)

( * ) Notice: Subject to any disclaimer, the term of this patent is extended or adjusted under 35 U.S.C. 154(b) by 785 days.

(21) Appl. No.: 12/607,455

(22) Filed: Oct. 28, 2009

(65) Prior Publication Data

US 2011/0098135 A1 Apr. 28, 2011

(51) Int. Cl.
*A63B 37/12* (2006.01)

(52) U.S. Cl.
USPC ..... 473/383

(58) Field of Classification Search
USPC ..... 473/379–385
See application file for complete search history.

(56) References Cited

U.S. PATENT DOCUMENTS

| | | | |
|---|---|---|---|
| 1,517,514 | A | 12/1924 | Hunt |
| 4,960,282 | A | 10/1990 | Shaw |
| 5,562,552 | A | 10/1996 | Thurman |
| 5,735,761 | A | 4/1998 | Palmquist |
| 5,916,044 | A | 6/1999 | Shimosaka et al. |
| 6,471,605 | B2 | 10/2002 | Ogg |
| 6,572,494 | B2 | 6/2003 | Emerson et al. |
| 6,626,772 | B1 | 9/2003 | Kennedy, III |
| 7,048,652 | B2 | 5/2006 | Sato et al. |
| 7,250,011 | B2 | 7/2007 | Simonds et al. |
| 7,455,601 | B2 | 11/2008 | Morgan et al. |
| 2005/0137032 | A1 | 6/2005 | Aoyama et al. |
| 2008/0051224 | A1 | 2/2008 | Sato et al. |
| 2009/0181805 | A1 | 7/2009 | Sullivan et al. |

FOREIGN PATENT DOCUMENTS

| | | |
|---|---|---|
| CN | 201049177 | 4/2008 |
| CN | 202070096 | 12/2011 |
| JP | 2003512141 | 4/2003 |
| JP | 2008132171 | 6/2008 |
| JP | 2011092713 | 5/2011 |
| TW | 153935 | 3/1991 |
| TW | 368865 | 9/1996 |
| TW | M294955 | 8/2006 |
| TW | 201119712 | 6/2011 |
| WO | 0130455 | 5/2001 |

OTHER PUBLICATIONS

Response to the European Patent Office on the European Search Report dated Nov. 4, 2011 in European Patent Application No. 10 188 371.8.
Intention to Grant from European Patent Office dated Jun. 4, 2012 in European Patent Application No. 10 188 371.8.
Chinese Office Action dated Mar. 1, 2011 in Chinese Application No. 201020583077.3.
Response to Chinese Office Action dated Apr. 14, 2011 in Chinese Application No. 201020583077.3.
Notification of Grant from Chinese Patent Office dated Aug. 8, 2011 in Chinese Application No. 201020583077.3.
Chinese Office Action dated Jan. 4, 2012, in Chinese Application No. 201010525485.8 and English translation thereof.

(Continued)

*Primary Examiner* — Raeann Gorden
(74) *Attorney, Agent, or Firm* — Plumsea Law Group, LLC

(57) ABSTRACT

A golf ball includes a projection that is positioned on a land adjacent two or more abutting dimples. The projection is located in a center or at a vertex of a shaped region defined by a pattern of dimples. A method for selecting a position for a projection and desirable configurations of the projection are also disclosed.

20 Claims, 20 Drawing Sheets

(56) References Cited

OTHER PUBLICATIONS

European Search Report dated Feb. 4, 2011 in European Application No. 10 18 8371.
Second Office Action in Chinese Invention Patent Application No. 201010525485.8, mailed on Aug. 28, 2012.
Observation of (Response to) the Second Office Action in Chinese Invention Patent Application No. 201010525485.8, submitted on Oct. 29, 2012.
Office Action for Japanese Patent Application No. 2010-239854, mailed Dec. 28, 2012.
Office Action for Chinese Invention Patent Application No. 201010525485.8, mailed on Jan. 14, 2013.
Response to Office Action mailed Jan. 14, 2013 for Chinese Invention Patent Application No. 201010525485.8, as filed on Mar. 13, 2013 and English translation thereof.
Notification of Grant of Patent Right for Invention issued May 6, 2013 for Chinese Invention Patent Application No. 201010525485.8.
Office Letter and the English translation of Search Report issued Feb. 26, 2013 for Taiwanese Patent Application No. 99135919.
Response to Office Action mailed Jan. 15, 2013 for Japanese Patent Application No. 2010-239854, as filed on May 9, 2013 and the English translation thereof.

GOLF BALL WITH PROJECTIONS ADJACENT DIMPLES

FIELD OF USE

The present embodiments relate generally to the design of a golf ball. More specifically, the present embodiments include a golf ball design that has an upward projection adjacent two or more dimples.

BACKGROUND

A typical ball 10 appears in FIG. 1. A typical ball has various characteristics. The ball has a particular weight, diameter, density, and dimple pattern. Striking a dimpled ball tends to create an improved flight path over striking a ball with no surface irregularities.

Golf balls are subject to two sets of rules. The first is the rules of the organization under whose rules the game is to be played. In many cases, that is the United States Golf Association (USGA). The USGA sets forth the limitations on golf balls to ensure that balls conform to certain standards to permit fairness among golfers. The USGA also certifies balls as meeting their rules.

There are a variety of rules a ball must follow under the USGA. For instance, the USGA has established rules regarding maximum weight, minimum size, and spherical symmetry. The maximum ball weight is 1.62 oz (45.93 g) and the minimum diameter is 1.68 inches (42.672) in diameter. The ball must be designed to be spherically symmetrical. These rules are updated every year, but the basic rules tend to remain the same.

The ball is also limited by the basic rules of physics. For example, balls fly differently based on the number, pattern, shape, and size of the dimples on the ball. Because many of the other variable features of the ball are regulated by the USGA, modifying the dimple patterns is a strategy used to improve the flight performance of the ball.

Modification of the size, number, and depth of the dimples can change the performance of a ball. On average, deep dimples on a ball tend to increase lift. Shallow dimples also allow the ball to have a higher trajectory and often create a longer flight time. Deep dimples allow the ball to have a lower trajectory an often create a longer run distance. This tends to create greater control, particularly in poor weather conditions. Increasing the number of dimples tends to create a straighter flight for the ball, but there is not a great deal of variation among balls that have between 300 and 500 dimples.

In addition to modifying the size and depth of the dimples, a ball will often have dimples that are arranged into a particular pattern. Common dimple patterns are the icosahedral and the dodecahedral. The icosahedral pattern is based on a polyhedron with twenty identical triangular faces, much like a twenty-sided die. Similarly, a dodecahedral is based on a polyhedron with twelve identical faces in the shape of pentagons. In addition, FIG. 2 shows a ball 20 that includes a dodecahedral pattern of multiple pentagons 22 on the surface of the ball 20. In addition to these patterns, other balls use other patterns that include multiple faces of varying polygonal and round shapes. Some balls include a pattern of dimples in a single shape and other balls include a pattern of dimples in a plurality of shapes.

Due to many factors, such as the limitations of the USGA rules and the materials from which balls are made, the ability to modify dimple size too greatly is limited. It is desirable that new and nonobvious structures that modify dimple size be developed.

SUMMARY

In one aspect, an embodiment provides a golf ball with an outer surface. A plurality of dimples appears on the outer surface of the ball. Each of the dimples is surrounded by a land. The dimples are arranged to form at least one shaped region. The shaped region has a center. A center section of the land is about at the center of the shaped region. A center projection extends from an edge of at least two adjacent dimples that abut the center section. The center projection has an upper surface above the land.

In another aspect, an embodiment provides a golf ball with an outer surface. A plurality of dimples appears on the outer surface of the ball. Each of the dimples is surrounded by a land. The dimples are arranged to form at least one polygonal region. The polygonal region has a plurality of vertices and a plurality of vertex sections of land. Each vertex section is about at one of the vertices of the polygonal region. The ball also includes a plurality of vertex projections. Each vertex projection extends from an edge of at least two adjacent dimples that abut each vertex section of the land. Each vertex projection has an upper surface above the land.

In another aspect, an embodiment provides a method of selecting a position for a projecting finger on a golf ball. A shaped region including lands and dimples is defined. A land position at about the center of the shaped region is selected.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
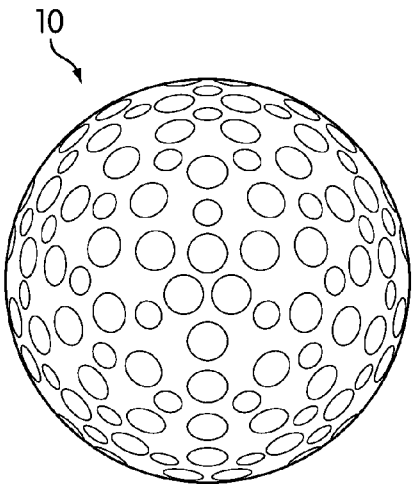
FIG. 1 is a plan view of a golf ball.
Figure 2:
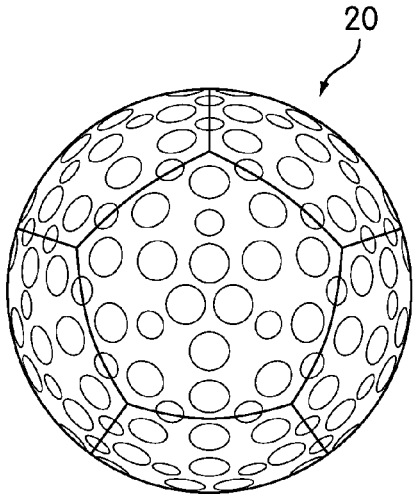
FIG. 2 is a plan view of a golf ball showing the dodecahedral pattern.
Figure 3:
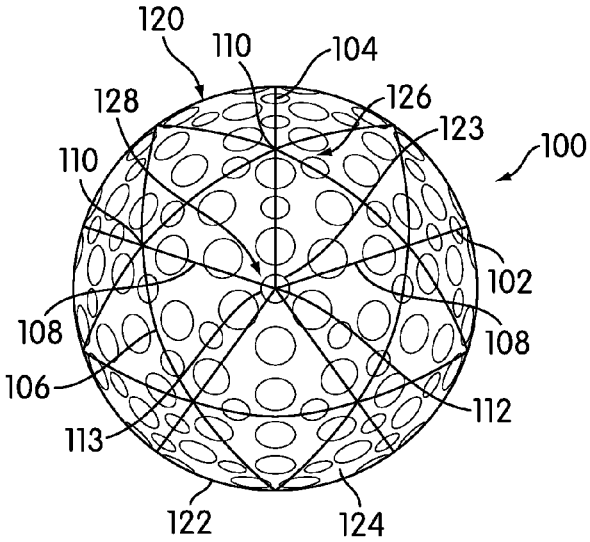
FIG. 3 is a plan view of a first embodiment of a golf ball showing the location of a center of one pentagonal region.

Turning first to FIG. 3, an embodiment of a golf ball 100 is disclosed. In the embodiment of FIG. 3, a golf ball 100 is shown that has a dodecahedron configuration or dimple pattern. The dodecahedral configuration is a dimple pattern that includes a series of polygons, specifically exemplary first pentagon 102, second pentagon 104, and third pentagon 106. Looking to the pentagon 106 that appears in the center of FIG. 3, there is shown a plurality of center-defining lines 108 that extend from each vertex 110 towards the center of the pentagon 106. Where those lines 108 meet is the approximate center 112 of the pentagon 106. Although various markings defining the pentagon and its components appear on this FIG., such markings would not be present on an actual ball. They are included in this and other FIGS. for a clearer understanding of the embodiments.

The golf ball 100 shown in FIG. 3 includes an outer surface 120. The outer surface includes dimples 122 and land 124. The land 124 forms a matrix among the dimples 122 and surrounds the dimples 122. In the golf ball 100 shown and in the remaining FIGS., the dimples 122 are of substantially similar size. However, the dimples 122 may instead have diameters or depths or both that differ from one another.

The golf ball 100 shown includes dimples 122 that are arranged to form a plurality of shaped regions, particularly the polygonal pentagonal regions 106 that are adjacent to one another and share edge regions. However, as noted, other configurations are possible. The regions could take any feasible polygonal shape, such as a square, triangle, octagon, or other multi-sided polygon. In such an instance, each polygon would include a plurality of vertices and a center that may be located in a manner similar to locating the center noted above. In other instances, the golf ball 100 may include dimples that are arranged to form only one or very few polygonal regions. These polygonal regions may be placed adjacent one another or may be remote from or opposite one another on the ball.

In other instances, the regions formed by the dimples may form shapes that are not polygonal. For example, the dimples may form circular shaped regions. In another instance, the dimples may form a less regularly shaped region. Where there is such a shaped region, a center can be located by various mathematical methods. In these shaped regions, there is no true vertex. However, in such an instance, vertex-like areas may be defined in substantially equal intervals around a periphery of the shaped region. In the case of either a shaped region or a polygonal region, the center may be about at the geometric center of the region.

Once the vertices 110 and center 112 of the polygonal region 106 have been located, a land for each vertex 110 and center 112 may be selected. As seen in FIG. 3, each vertex 110 falls on a point on the land 124. The portion of the land 124 on which the vertex 110 falls may be defined as a vertex land section 126. In many instances, however, the vertex 110 and center 112 may fall within a dimple 122. In FIG. 3, for example, an exemplary center 113 falls within dimple 123. In such an instance, a land section adjacent the center 113 is selected to be defined as a center land section 128. In the example shown in FIG. 3, the center land section 128 is slightly to the left and below the center 113. However, another of the land sections abutting or adjacent the center dimple 123 may be selected instead. In an instance where there a plurality of similar shaped or polygonal regions is positioned on an outer surface of a ball, it may be desirable to use a similar rule to select a land section for each of the regions. Applying such a rule may allow a ball to have spherical symmetry. This method of selecting land sections allows the positioning of a vertex section 126 at about a vertex 110 and a center section 128 at about a center 112.

Figure 4:
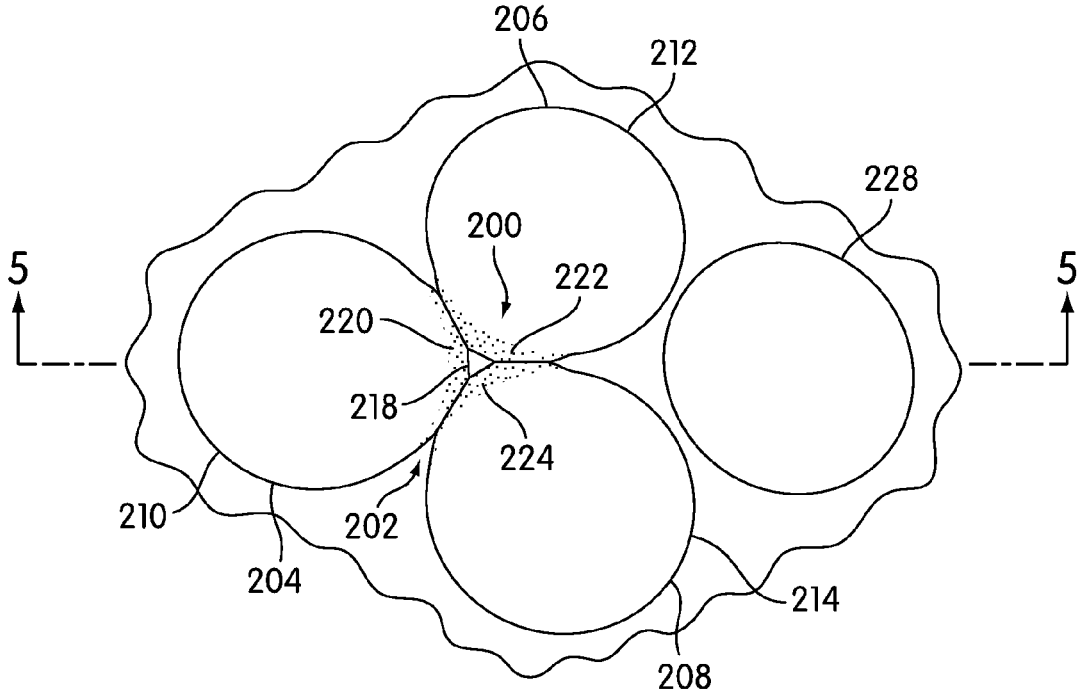
FIG. 4 is a top view of a first embodiment of a projection.
Figure 5:
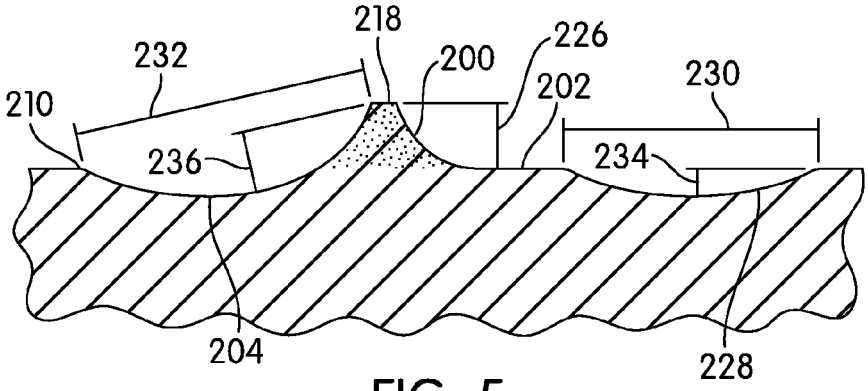
FIG. 5 is a partial cross sectional view of the first embodiment of the projection taken along line 5-5 of FIG. 4.
Figure 6:
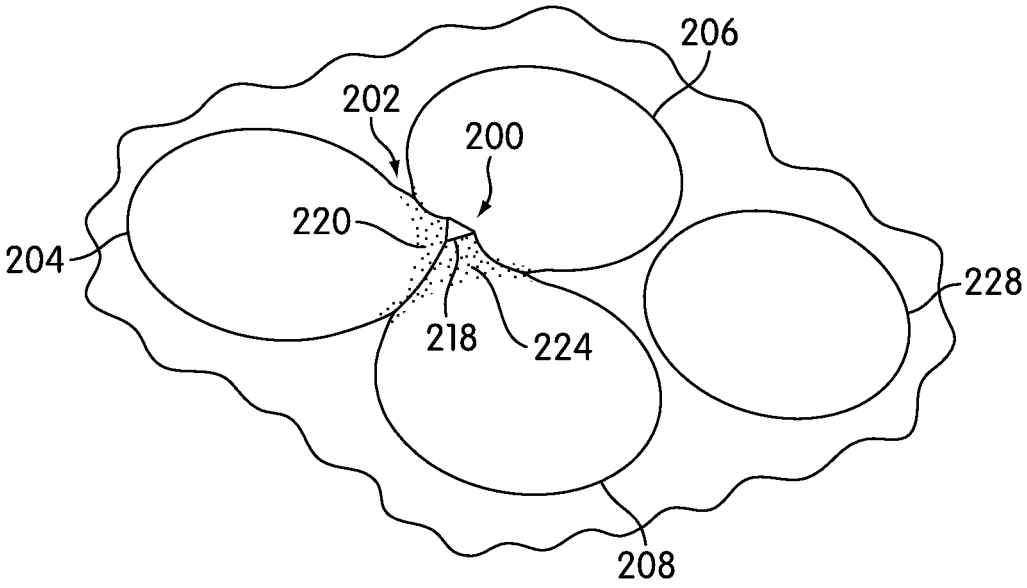
FIG. 6 is an isometric view of the first embodiment of the projection.

Turning now to FIGS. 4-6, a first embodiment of a projection or projecting finger 200 is shown. The projection 200 is positioned on a land section 202. Three dimples, specifically first dimple 204, second dimple 206, and third dimple 208, are adjacent one another and abut the land section 202. As shown most clearly in FIG. 5, the projection 200 extends continuously or as a continuous surface from first edge or rim 210 of first dimple 204 to an upper surface 218. While not detailed in cross sectional views, the projection also extends continuously from the second edge 212 of second abutting dimple 206 and third edge 214 of third abutting dimple 208. The stippling in FIGS. 4 and 6 on first side 220, second side 222, and third side 224 of the projection 200 is provided as a visual aid to more clearly see the side of the projection, but does not represent a discontinuity or any additional surface feature or any additional surface feature. Each of the first side 220, second side 222, and third side 224 extends laterally at least a portion of the circumference or rim of a corresponding first dimple 204, second dimple 206, and third dimple 208. Each of the first side 220, second side 222, and third side 224 extends upwardly to an upper surface 218. The upper surface 218 of the projection 200 is positioned above the level of the land 202 by a height 226. An appropriate height 226 may be selected based on a variety of factors, including, for example, the desire for a particular air flow around the projection, the choice of materials to be used in creating the ball, a desired ball density, or any other factors that a designer deems important or desirable. In some instances, the height 226 may be between about 0.1 mm and about 1 mm. The surface area of the upper surface 218 may also be selected based on similar considerations, but may be less than about 1.5 square millimeters.

Among the reasons a projection 200 of a particular height may be desirable is that the use of a projection 200 may increase the effective diameter and depth of a particular dimple. FIG. 5 shows the change in the effective diameter and depth between a non-abutting dimple 228 and an abutting dimple 202. The non-abutting dimple 228 has a diameter 230. The abutting dimple 202 has an effective diameter 232, which is greater than the diameter 230. The non-abutting dimple 228 has a depth 234. The abutting dimple 202 has an effective depth 236, which is greater than the depth 234. These changes in shape, size, and depth may affect the air flow around the projection and the ball as a whole and may create a different flight path for the ball than that created by a ball having no projections.

Figure 7:
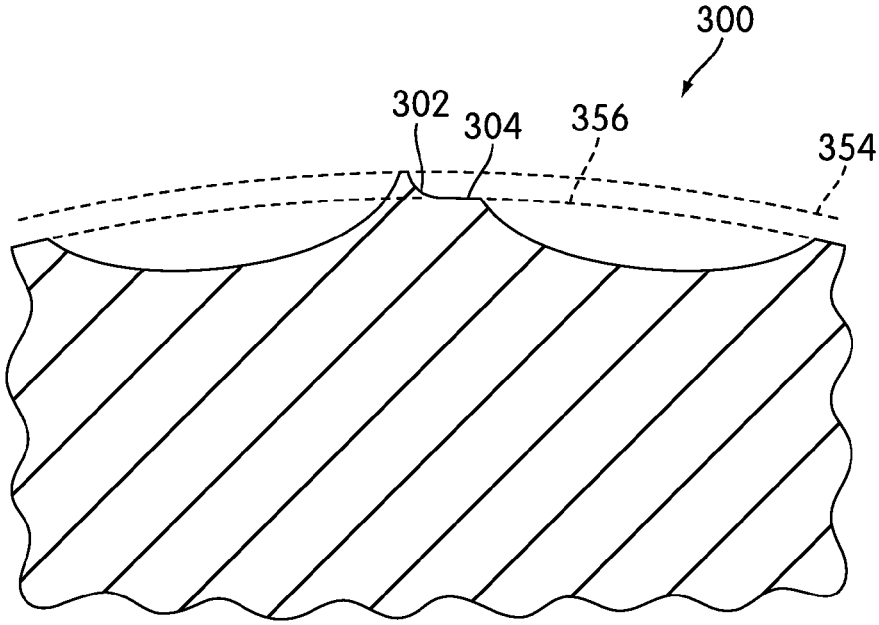
FIG. 7 is a partial cross sectional view of the first embodiment of the projection.
Figure 8:
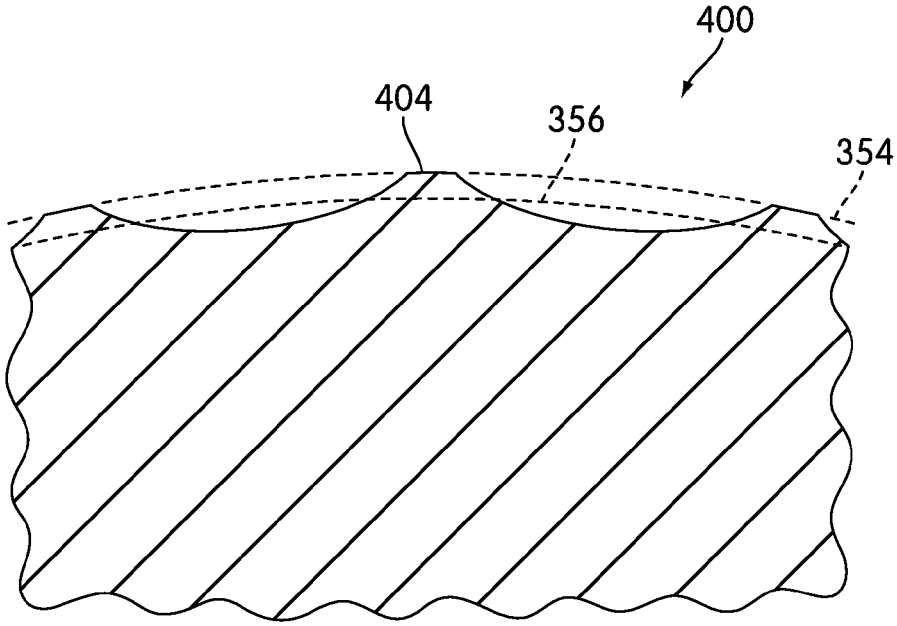
FIG. 8 is a partial cross sectional view of a traditional golf ball.
Figures 9, 10:
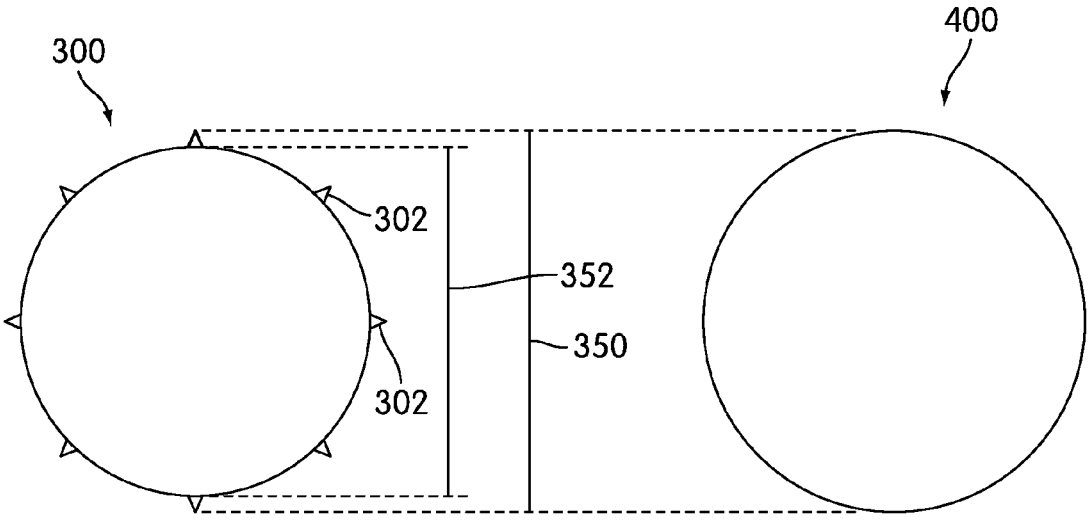
FIG. 9 is a sectional view of a ball incorporating a plurality of projections.
FIG. 10 is a sectional view of a traditional golf ball.

The use of projections in a plurality of locations around a ball may also affect the volume of the ball, as is shown in FIGS. 7-10. FIGS. 7 and 9 show cross sections of a ball 300 that includes projections 302. FIGS. 8 and 10 show cross sections of a ball 400 that is conventional and does not include projections. Turning first to FIGS. 9 and 10, it may be observed that the diameter 350 of the balls 300, 400 is the same. While a golf ball may have any diameter, it may be useful to make a golf ball that is at least as big as any minimum size requirements of the USGA or other certifying agency. If a ball 300 with projections 302 is used, the diameter 352 of the ball 300 at the level of lands 304 on the ball 300 is smaller than the diameter 350 at the level of the projections 302 and at the level of the lands 404 on the ball 400. This may also be observed in FIGS. 7 and 8. A circle 354 having a diameter 350 may be circumscribed around each ball 300, 400. A circle 356 having a diameter 352 may also be circumscribed around each ball 300, 400. The difference in diameters at the level of the lands 304, 404 indicates that while the two balls have the same total diameter 350, the volume of material in the ball 300 will be less than the volume of material in the ball 400. If the two balls 300, 400 have the same weight, such as the maximum permitted weight under a set of rules, the ball 300 can have a greater density. This greater density also changes the flight path of the ball. Thus, the use of the projections 302 on the ball 300 is likely to have a variety of effects on the path of the ball 300 when compared with the path of the ball 400. The use of the projections 302 may also allow the ball to be modified in other ways to achieve different performance characteristics. For example, the use of the projections may allow for the use of a different overall dimple configuration, a different ball density, or a different material to be used to create a different set of features for the ball.

FIGS. 11-14 are included to show a variety of locations on a ball on which a projection may be placed. While any of the projections disclosed in this disclosure may be placed in a variety of locations around the ball, it may be useful to correlate the position of the projections with the dimple patterns on the ball. While certain locations are noted as being desirable, a person having ordinary skill in the art will be able to select an appropriate location for an appropriate projection based on the flight path characteristics and other features the designer things are desirable. The locations specifically disclosed are merely exemplary. In FIGS. 11-14, desirable locations of the projections are shown as circular areas with stippling. The use of the circular areas and stippling is to show the location more clearly on the ball, rather than to indicate any particular shape or texture.

Figure 11:
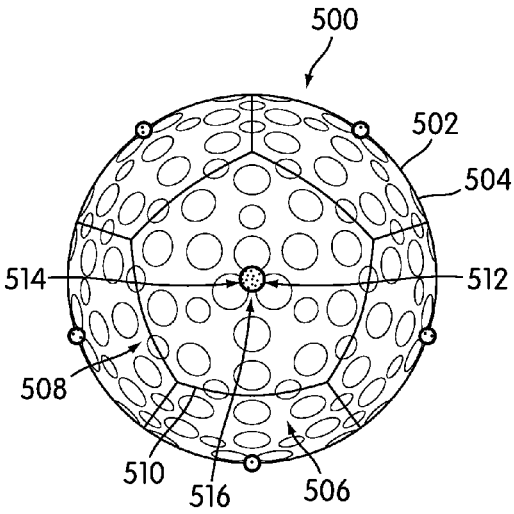
FIG. 11 is an isometric view of a first embodiment of a ball showing projections in center sections.

Turning now to FIG. 11, a ball 500 is shown. The ball 500 has an outer surface 502 that includes dimples 504 and a land 506 surrounding each dimple 504. The dimples 504 are arranged to form a shaped region 508. In the embodiment shown in FIG. 11, the shaped region 508 is a polygonal region, specifically, pentagon region 510. As described in greater detail earlier, the pentagonal region 510 has a center 512, and a center section 514 of the land 504 is about at the center 512 of the shaped or polygonal or pentagonal region 510. A center projection 516 is positioned on the center section 514 of the land 504. The center projection 516 may be any of the embodiments of projections described in the present disclosure.

Figure 12:
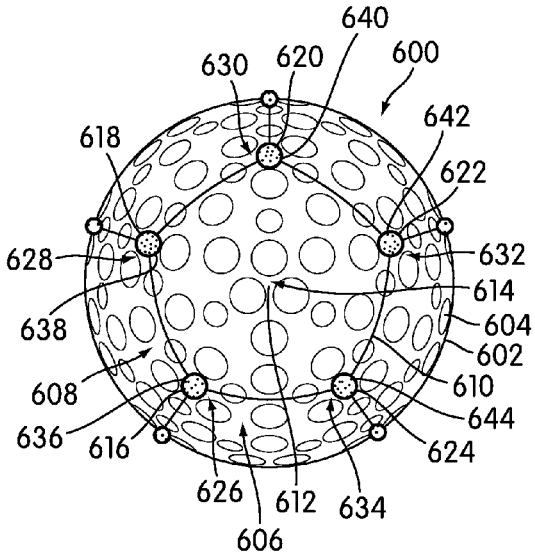
FIG. 12 is an isometric view of a second embodiment of a ball showing projections in vertex sections.

Turning now to FIG. 12, a ball 600 is shown. The ball 600 has an outer surface 602 that includes dimples 604 and a land 606 surrounding each dimple 604. The dimples 604 are arranged to form a shaped region 608. In the embodiment shown in FIG. 12, the shaped region 608 is a polygonal region, specifically, pentagon region 610. As described in greater detail earlier, the pentagonal region 610 has a center 612, and a center section 614 of the land 604 is about at the center 612 of the shaped or polygonal or pentagonal region 610. The pentagonal region 610 also includes five vertices. The five vertices include a first vertex 616, a second vertex 618, a third vertex 620, a fourth vertex 622, and a fifth vertex 624. A vertex section of land is positioned at each vertex. These vertex sections of land include first vertex section 626, second vertex section 628, third vertex section 630, fourth vertex section 632, and fifth vertex section 634. A vertex projection is positioned a corresponding vertex section of the land 606. These vertex projections include first vertex projection 636, second vertex projection 638, third vertex projection 640, fourth vertex projection 642, and fifth vertex projection 644. Each vertex projection may be any of the embodiments of projections described in the present disclosure.

Figure 13:
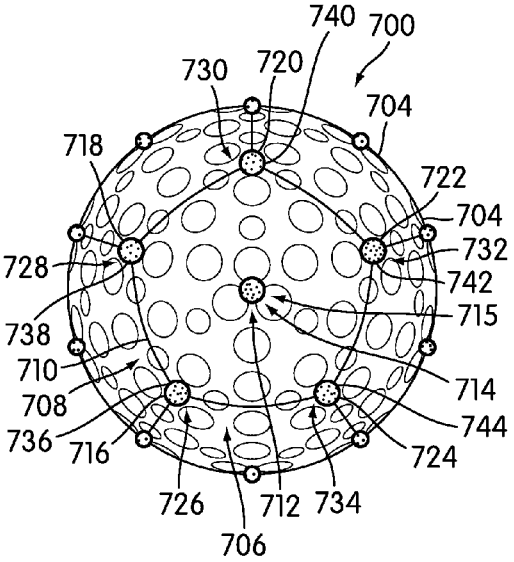
FIG. 13 is an isometric view of a third embodiment of a ball showing projections in center and vertex sections.

Turning now to FIG. 13, a ball 700 is shown. The ball 700 has an outer surface 702 that includes dimples 704 and a land 706 surrounding each dimple 704. The dimples 704 are arranged to form a shaped region 708. In the embodiment shown in FIG. 13, the shaped region 708 is a polygonal region, specifically, pentagon region 710. As described in greater detail earlier, the pentagonal region 710 has a center 712, and a center section 714 of the land 704 is about at the center 712 of the shaped or polygonal or pentagonal region 710. A center projection 715 is positioned on the center section 714 of the land 704. The center projection 715 may be any of the embodiments of projections described in the present disclosure. The pentagonal region 710 also includes five vertices. The five vertices include a first vertex 716, a second vertex 718, a third vertex 720, a fourth vertex 722, and a fifth vertex 724. A vertex section of land is positioned at each vertex. These vertex sections of land include first vertex section 726, second vertex section 728, third vertex section 730, fourth vertex section 732, and fifth vertex section 734. A vertex projection is positioned a corresponding vertex section of the land 706. These vertex projections include first vertex projection 736, second vertex projection 738, third vertex projection 740, fourth vertex projection 742, and fifth vertex projection 744. Each vertex projection may be any of the embodiments of projections described in the present disclosure.

Figure 14:
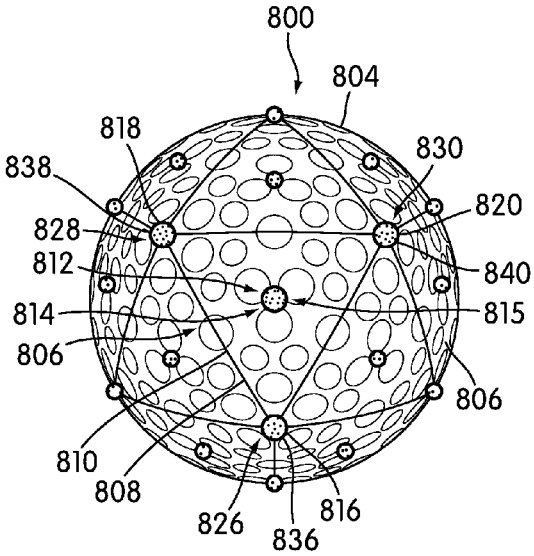
FIG. 14 is an isometric view of a fourth embodiment of a ball showing projections in center and vertex sections.

Turning now to FIG. 14, a ball 800 is shown. The ball 800 has an outer surface 802 that includes dimples 804 and a land 806 surrounding each dimple 804. The dimples 804 are arranged to form a shaped region 808. In the embodiment shown in FIG. 14, the shaped region 808 is a polygonal region, specifically, triangle region 810. As described in greater detail earlier, the triangular region 810 has a center 812, and a center section 814 of the land 804 is about at the center 812 of the shaped or polygonal or triangular region 810. A center projection 815 is positioned on the center section 814 of the land 804. The center projection 815 may be any of the embodiments of projections described in the present disclosure. The triangular region 810 also includes three vertices. The three vertices include a first vertex 816, a second vertex 818, and a third vertex 820. A vertex section of land is positioned at each vertex. These vertex sections of land include first vertex section 826, second vertex section 828, and third vertex section 830. A vertex projection is positioned a corresponding vertex section of the land 806. These vertex projections include first vertex projection 836, second vertex projection 838, and third vertex projection 840. Each vertex projection may be any of the embodiments of projections described in the present disclosure.

FIGS. 2-4 and 15-36 disclose a variety of embodiments of projections. Projections having different characteristics will affect a ball flight path differently. The embodiments shown are exemplary of ways a projection could be designed. Any of the disclosed projections may be placed on the ball in accordance with the positioning described in connection with FIGS. 11-14. Any of the projections may be used with any of the other projections on a ball. For example, a ball could have projections arranged as shown in FIG. 11 and have some projections shaped like the projection 900 shown in FIGS. 15-17 and other projections shaped like the projection 1000 shown in FIGS. 18-20.

Each projection in each embodiment may have an upper surface positioned at a height over a corresponding land on the ball. An appropriate height may be selected based on a variety of factors, including, for example, the desire for a particular air flow around the projection, the choice of materials to be used in creating the ball, a desired ball density, or any other factors that a designer deems important or desirable or desirable. In some instances, the height may be between about 0.1 mm and about 1 mm. The shape and surface area of the upper surface of any projection may be selected based on the same or other factors, but also may be less than about 1.5 square mm.

Figure 15:
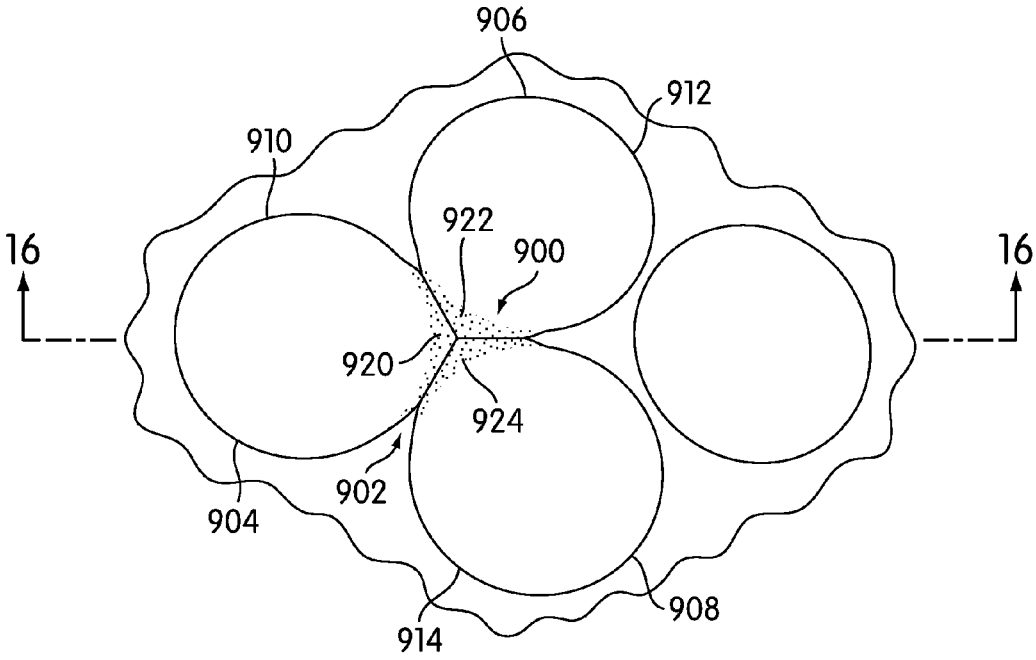
FIG. 15 is a top view of an alternative embodiment of a projection.
Figure 16:
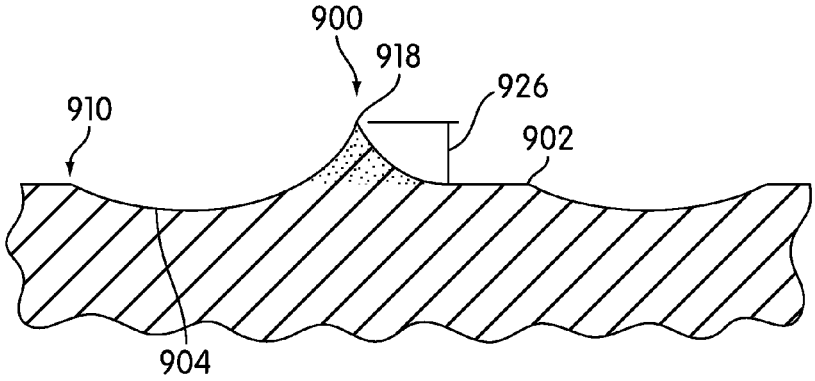
FIG. 16 is a partial cross sectional view of the embodiment of the projection of FIG. 15 taken along line 16-16 of FIG. 15.
Figure 17:
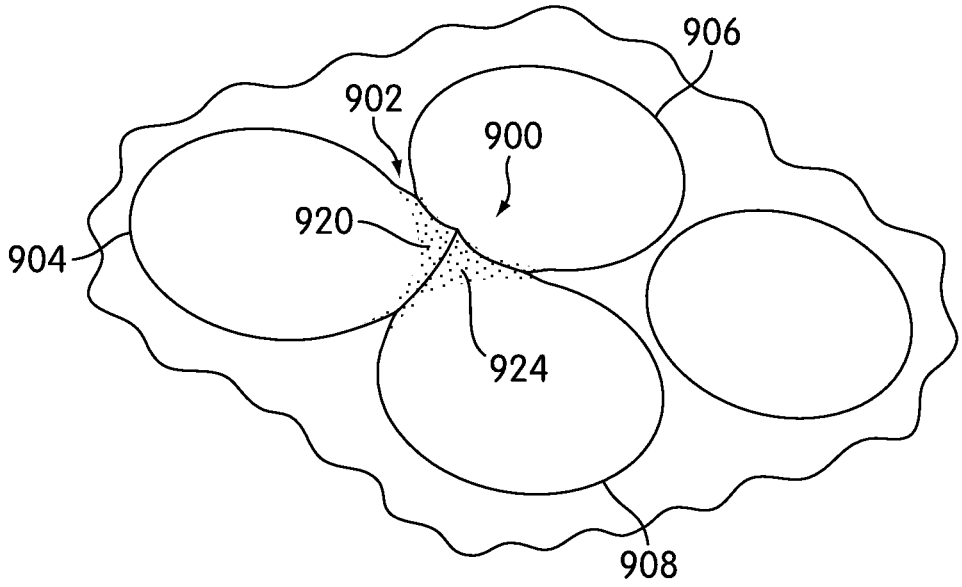
FIG. 17 is an isometric view of the embodiment of the projection of FIG. 15.

Turning now to FIGS. 15-17, an alternative embodiment of the projection is shown. The projection 900 is positioned on a land section 902. Three dimples, specifically first dimple 904, second dimple 906, and third dimple 908, are adjacent one another and abut the land section 902. As shown most clearly in FIG. 16, the projection 900 extends continuously or as a continuous surface from the first edge or rim 910 of first dimple 904 to an upper surface or point 918. While not detailed in cross sectional views, the projection also extends continuously from the second edge 912 of the second dimple 906 and the third edge 914 of the third dimple 908. The stippling in FIGS. 15 and 17 on the first side 920, second side 922, and third side 924 of the projection 900 is provided as a visual aid to more clearly see the side of the projection, but does not represent a discontinuity or any additional surface feature. Each of the first side 920, second side 922, and third side 924 extends laterally at least a portion of the circumference or rim of a corresponding first dimple 904, second dimple 906, and third dimple 908. Each of the first side 920, second side 922, and third side 924 extends upwardly to an upper surface 918. The uppermost point or surface 918 of the projection 900 is positioned above the level of the land 902 by a height 926.

Figure 18:
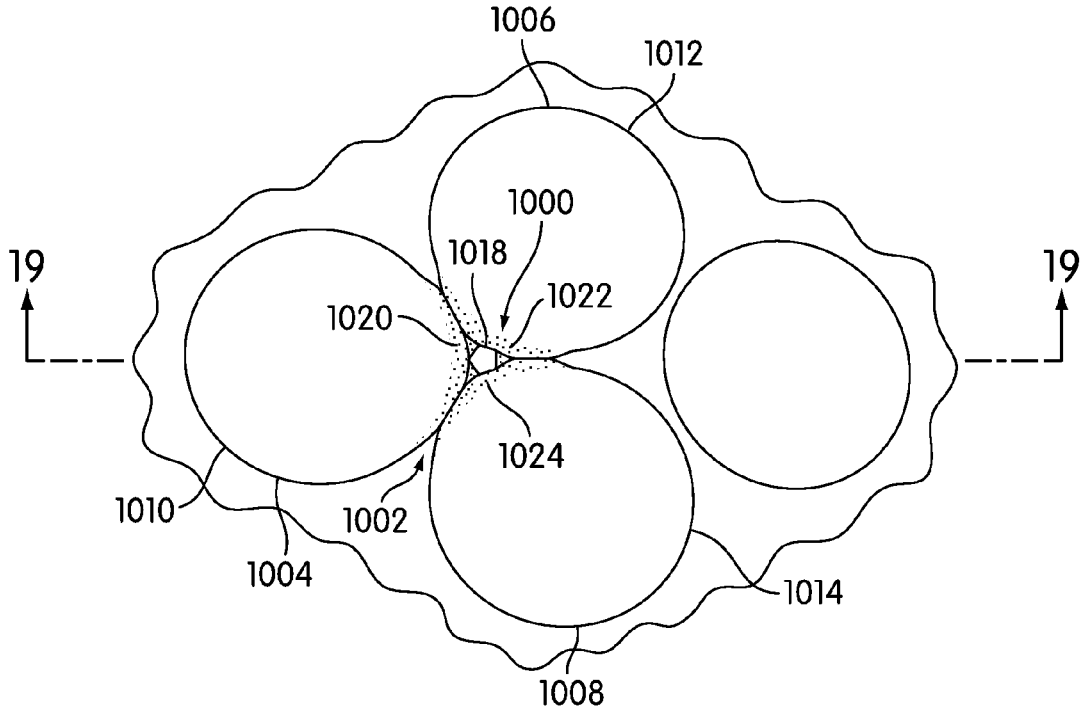
FIG. 18 is a top view of another alternative embodiment of a projection.
Figure 19:
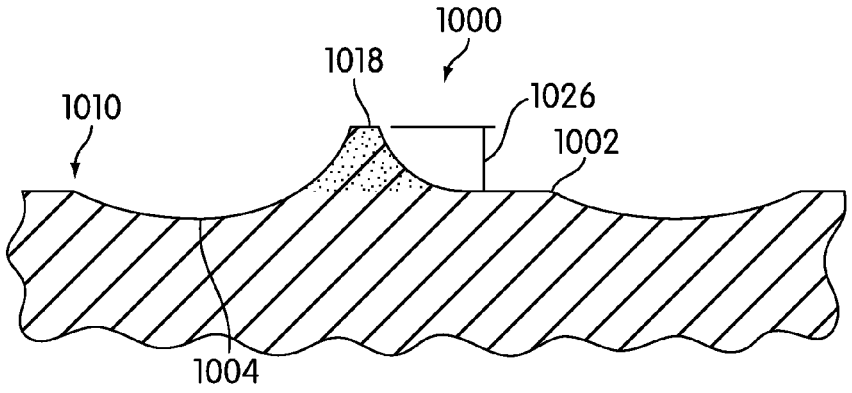
FIG. 19 is a partial cross sectional view of the embodiment of the projection of FIG. 18 taken along line 19-19 of FIG. 18.
Figure 20:
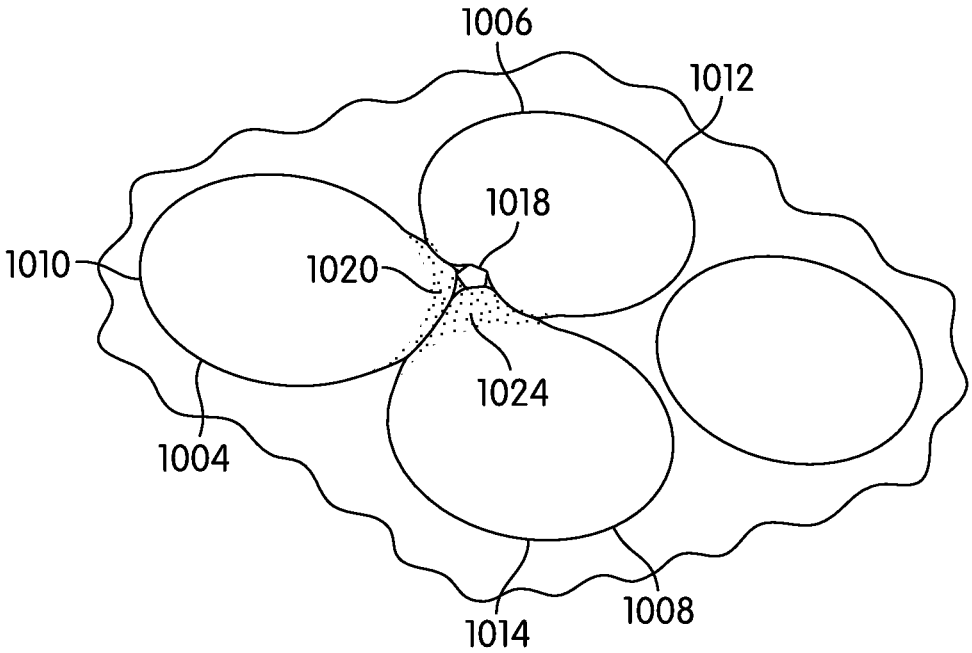
FIG. 20 is an isometric view of the embodiment of the projection of FIG. 18.

Turning now to FIGS. 18-20, an alternative embodiment of a projection is shown. The projection 1000 is positioned on a land section 1002. First dimple 1004, second dimple 1006, and third dimple 1008 are adjacent one another and abut the land section 1002. As shown most clearly in FIG. 19, the projection 1000 extends continuously or as a continuous surface from the first edge or rim 1010 of dimple 1004 to an upper surface 1018. While not detailed in cross sectional views, the projection also extends continuously from the second edge 1012 of the second dimple 1006 and the third edge 1014 of the third dimple 1008. The stippling in FIGS. 18 and 20 on the first side 1020, second side 1022, and third side 1024 of the projection 1000 is provided as a visual aid to more clearly see the side of the projection, but does not represent a discontinuity or any additional surface feature. Each of the first side 1020, second side 1022, and third side 1024 extends laterally at least a portion of the circumference or rim of a corresponding first dimple 1004, second dimple 1006, and third dimple 1008. Each of the first side 1020, second side 1022, and third side 1024 extends upwardly to an upper surface 1018. The upper surface 1018 of the projection 1000 is positioned above the level of the land 1002 by a height 1026. In this embodiment, the upper surface 1018 is pentagonal.

Figure 21:
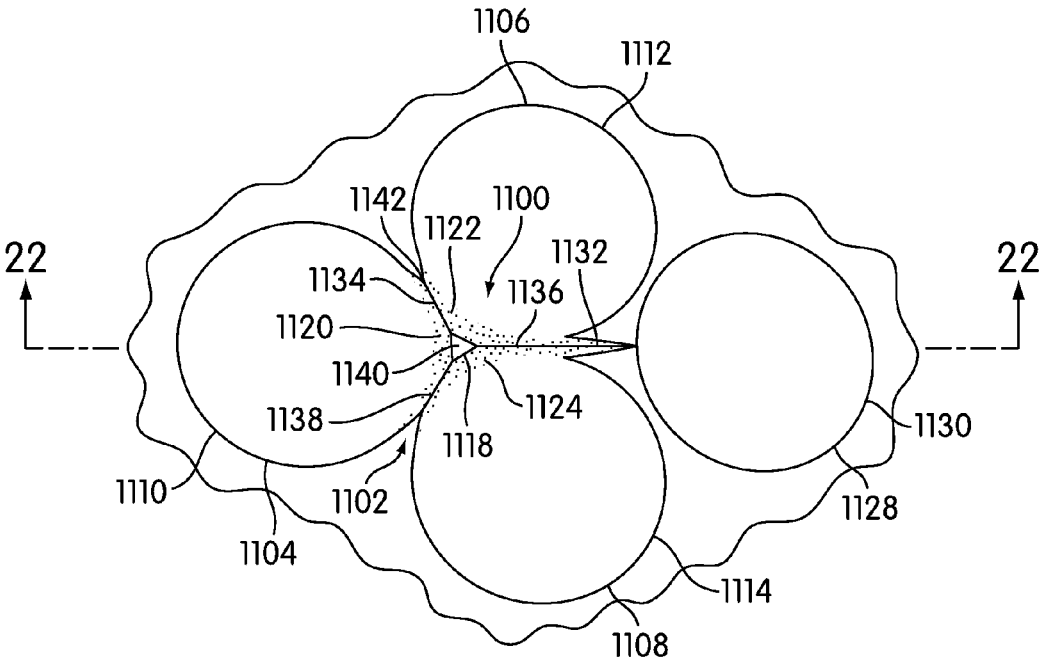
FIG. 21 is a top view of another alternative embodiment of a projection.
Figure 22:
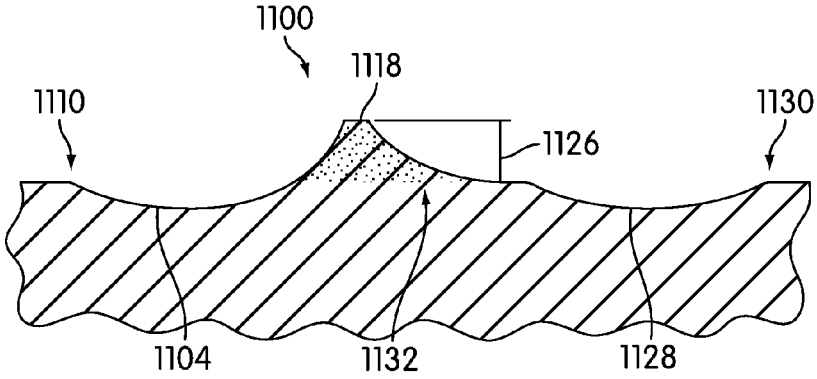
FIG. 22 is a partial cross sectional view of the embodiment of the projection of FIG. 21 taken along line 22-22 of FIG. 21.
Figure 23:
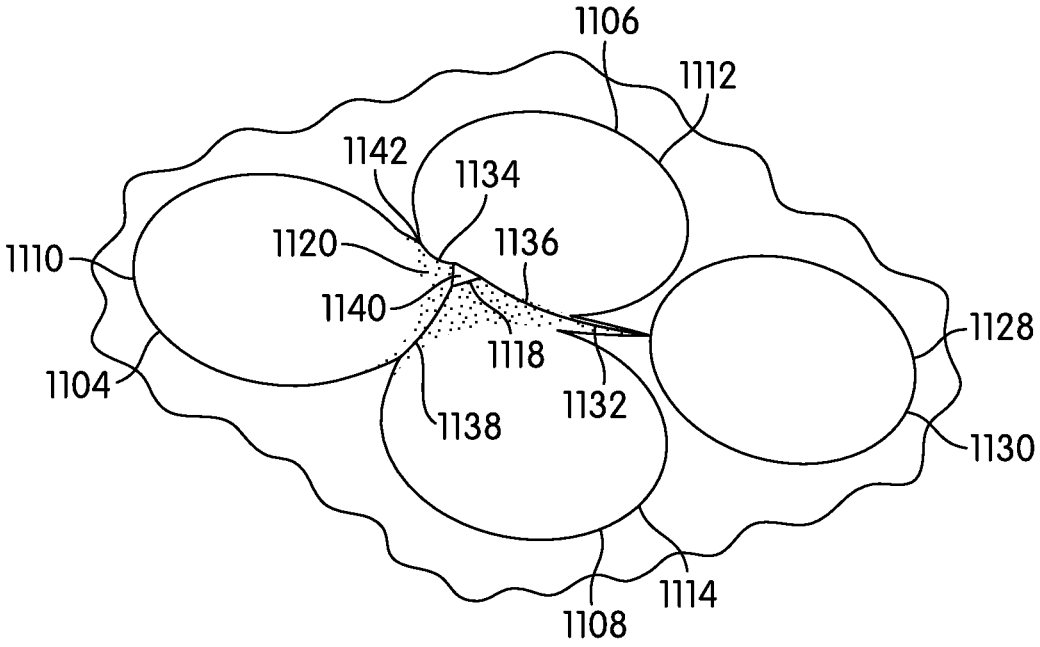
FIG. 23 is an isometric view of the embodiment of the projection of FIG. 21.

Turning now to FIGS. 21-23, an alternative embodiment of a projection is shown. The projection 1100 is positioned on a land section 1102. First dimple 1104, second dimple 1106, and third dimple 1108 are adjacent one another and abut the land section 1102. As shown most clearly in FIG. 22, the projection 1100 extends continuously or as a continuous surface from the first edge or rim 1110 of first dimple 1104 to an upper surface 1118. While not detailed in cross sectional views, the projection also extends continuously from the second edge 1112 of second abutting dimple 1106 and third edge 1114 of third abutting dimple 1108. The stippling in FIGS. 21 and 23 on the first side 1120, second side 1122, and third side 1124 of the projection 1100 is provided as a visual aid to more clearly see the side of the projection, but does not represent a discontinuity or any additional surface feature. Each of the first side 1120, second side 1122, and third side 1124 extends laterally at least a portion of the circumference or rim of a corresponding first dimple 1104, second dimple 1106, and third dimple 1108. Each of the first side 1120, second side 1122, and third side 1124 extends upwardly to an upper surface 1118. The upper surface 1118 of the projection 1100 is positioned above the level of the land 1102 by a height 1126. In this embodiment, the upper surface 1118 is triangular.

The projection 1100 includes first arm 1134, second arm 1136, and third arm 1138. As noted above, the projection 1100 may be formed such that each of the first side 1120, second side 1122, and third side 1124 of the projection 1100 is formed in a continuous curve from the bottom of a corresponding first dimple 1104, second dimple 1106, and third dimple 1108. Where two of the corresponding walls meet is formed a corresponding arm. For example, at the location where wall 1120 and wall 1122 meet is positioned arm 1134. The length of any particular arm, such as arm 1134, is variable. The length of arm 1134 may be the distance from the center 1140 of the projection 1100 to a point 1142 that is the position where two corresponding dimples, in this case first dimple 1104 and second dimple 1106, reach their closest point in the absence of a projection. In many cases, it may be desirable to allow the height of the arm to taper or decrease from a maximum height that equals the height 1126 of the projection 1100 to a minimum height of zero, or to the height of the land 1102 at the point 1142. This taper may allow for a smoother transition from the land 1102 to the projection 1100 and may be desirable for airflow. While these features of this embodiment were not described in detail in relation to the remaining embodiments, it will be apparent to one having ordinary skill in the art that these features are present or can be incorporated into any of the other designs of the projection disclosed herein.

In some instances, the taper of the arm can be modified. As may be seen in FIGS. 21-23, the taper of an arm 1136 can be reduced to further extend the arm 1136 into a tail 1132. The point of transition between the arm 1136 and the tail 1132 is about the position where the arm 1136 ceases to continuously extend into second dimple 1106 and third dimple 1108. Instead, the continuation of the arm where the taper exists only on a section of the land 1102 may be considered a tail 1132. The tail 1132 may extend until it contact a non-abutting dimple, such as dimple 1128. Where the tail 1132 contacts the rim 1130 of the remote dimple 1128, the height of the tail 1132 may desirably be close to zero to allow a smooth transition into the dimple 1128. While only one arm 1136 is shown as continuing to taper to form a tail 1132, it will be apparent to a person having ordinary skill in the art that more than one arm can be configured to include a tail.

Figure 24:
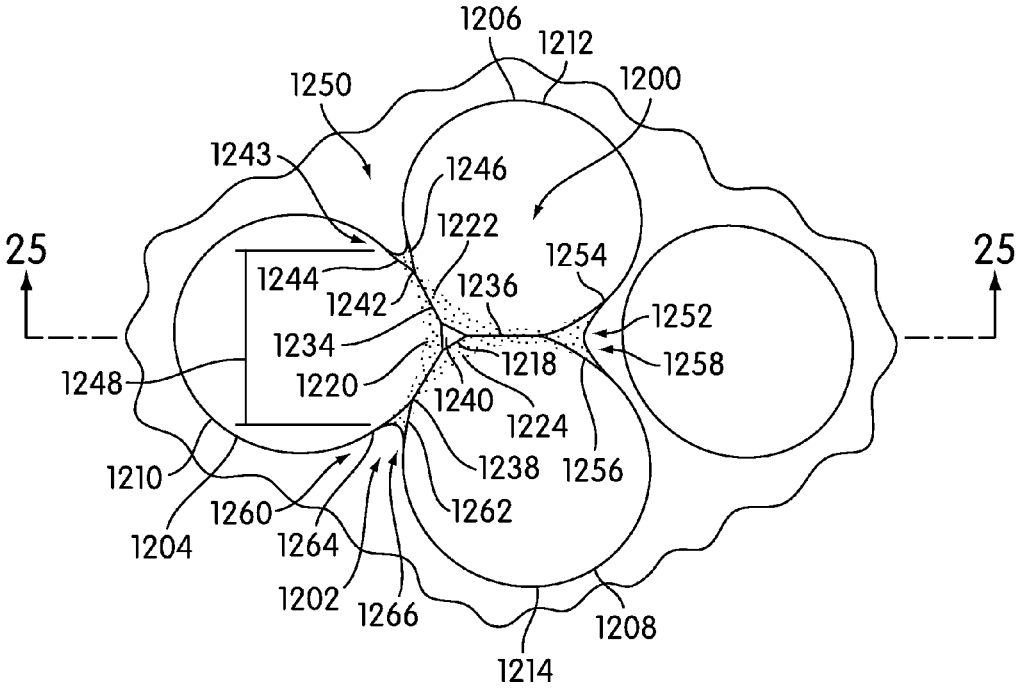
FIG. 24 is a top view of an alternative embodiment of a projection.
Figure 25:
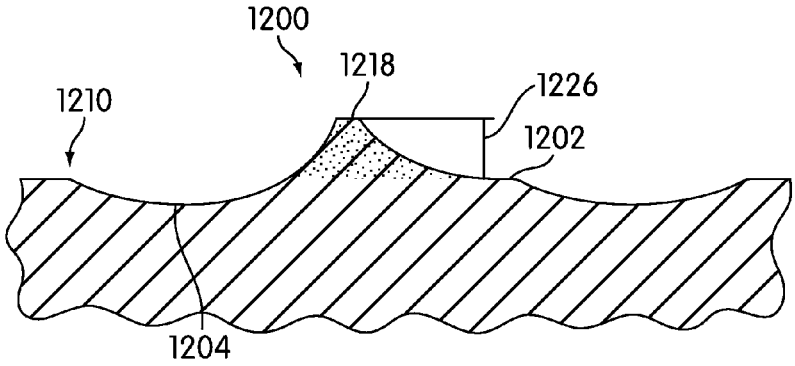
FIG. 25 is a partial cross sectional view of the embodiment of the projection of FIG. 24 taken along line 25-25 of FIG. 24.
Figure 26:
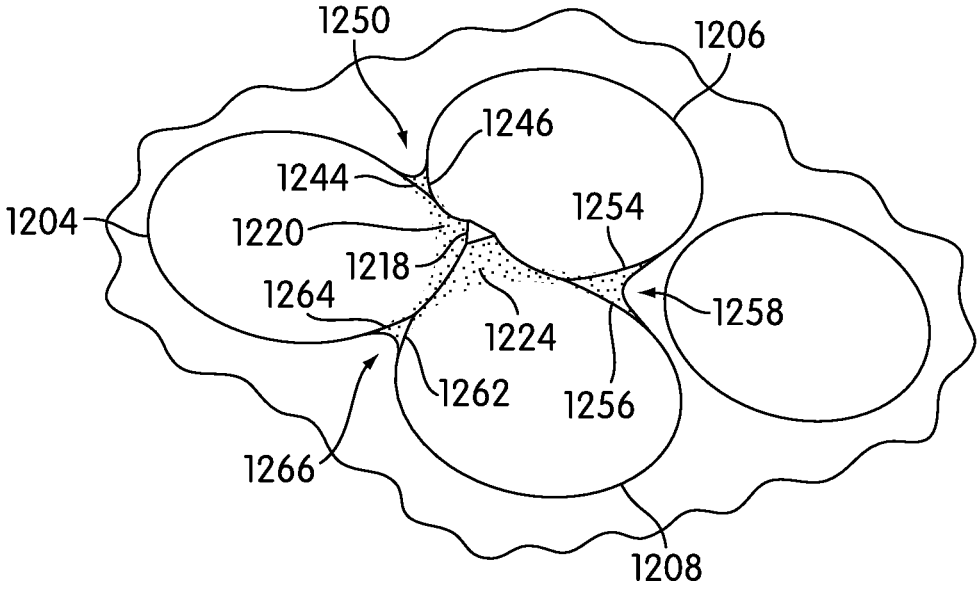
FIG. 26 is an isometric view of the embodiment of the projection of FIG. 24.

Turning now to FIGS. 24-26, an alternative embodiment of a projection is shown. The projection 1200 is positioned on a land section 1202. First dimple 1204, second dimple 1206, and third dimple 1208 are adjacent one another and abut the land section 1202. As shown most clearly in FIG. 25, the projection 1200 extends continuously or as a continuous surface from the first edge or rim 1210 of first dimple 1204 to an upper surface 1218. While not detailed in cross sectional views, the projection also extends continuously from the second edge 1212 of second abutting dimple 1206 and third edge 1214 of third abutting dimple 1208. The stippling in FIGS. 24 and 26 on the first side 1220, second side 1222, and third side 1224 of the projection 1200 is provided as a visual aid to more clearly see the side of the projection, but does not represent a discontinuity or any additional surface feature. Each of the first side 1220, second side 1222, and third side 1224 extends laterally at least a portion of the circumference or rim of a corresponding first dimple 1204, second dimple 1206, and third dimple 1208. Each of the first side 1220, second side 1222, and third side 1224 extends upwardly to an upper surface 1218. The upper surface 1218 of the projection 1200 is positioned above the level of the land 1202 by a height 1226. In this embodiment, the upper surface 1218 is triangular.

The projection 1200 includes first arm 1234, second arm 1236, and third arm 1238. As noted above, the projection 1200 may be formed such that each of the first side 1220, second side 1222, and third side 1224 of the projection 1200 is formed in a continuous curve from the bottom of a corresponding first dimple 1204, second dimple 1206, and third dimple 1208. Where two of the corresponding walls meet is formed a corresponding arm. For example, at the location where wall 1220 and wall 1222 meet is positioned arm 1234. The length of any particular arm, such as arm 1234, is variable. The length of arm 1234 may be the distance from the center 1240 of the projection 1200 to a point 1242 that is the position where two corresponding dimples, in this case first dimple 1204 and second dimple 1206, reach their closest point in the absence of a projection. In many cases, it may be desirable to allow the height of the arm to taper or decrease from a maximum height that equals the height 1226 of the projection 1200 to a minimum height of zero, or to the height of the land. This taper may allow for a smoother transition from the land 1202 to the projection 1200 and may be desirable for airflow.

In some instances, the taper of the arm and the length of the side of the projection can be modified. As may be seen in FIGS. 24-26, the taper of arm 1234 can be reduced to further extend the arm 1234 into a fork 1243 including first leg 1244 adjacent first dimple 1204 and second leg 1246 adjacent second dimple 1206. The point of transition between the arm 1234 and the first leg 1244 and second leg 1246 is about the point 1242 where the first dimple 1204 and second dimple 1206 reach their closest point. The continuation of the arm 1234 beyond this point may be considered the fork 1243. For varying reasons, including to modify the air flow over the ball, a person having ordinary skill in the art may wish for the length 1248 of the side 1220 to be greater than it would be if there were no fork 1243. When the arm 1234 extends into a fork 1243, it may be desirable that there be a valley 1250 created between the first leg 1244 and the second leg 1246, rather than continuing the arm 1234. In the embodiment shown in FIGS. 24-26, the second arm 1236 and third arm 1238 each have a configuration similar to that of first arm 1234. Second arm 1236 extends into a second fork 1252. Second fork 1252 includes third leg 1254 adjacent the second dimple 1206 and fourth leg 1256 adjacent the third dimple 1208. A valley 1258 is between the third leg 1254 and the fourth leg 1256. Third arm 1238 extends into a third fork 1260. Third fork 1260 includes fifth leg 1262 adjacent third dimple 1208 and sixth leg 1264 adjacent first dimple 1204. A valley 1266 is between the fifth leg 1262 and the sixth leg 1264. While the embodiment shown in FIGS. 24-26 shows each arm as including a fork with two legs, a person having ordinary skill in the art can easily modify the design to include a fork having only a single leg or legs of varying lengths either on the same or different arms. In addition, a person having ordinary skill in the art could easily modify the design to include a fork on fewer than all the arms of the projection.

Figure 27:
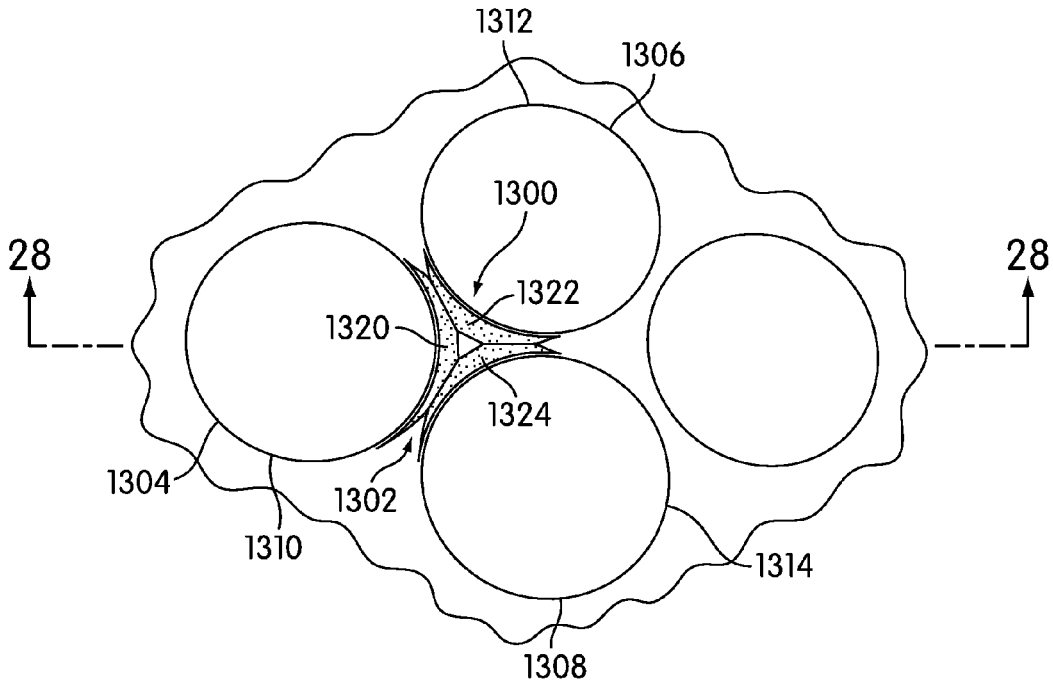
FIG. 27 is a top view of an alternative embodiment of a projection.
Figure 28:
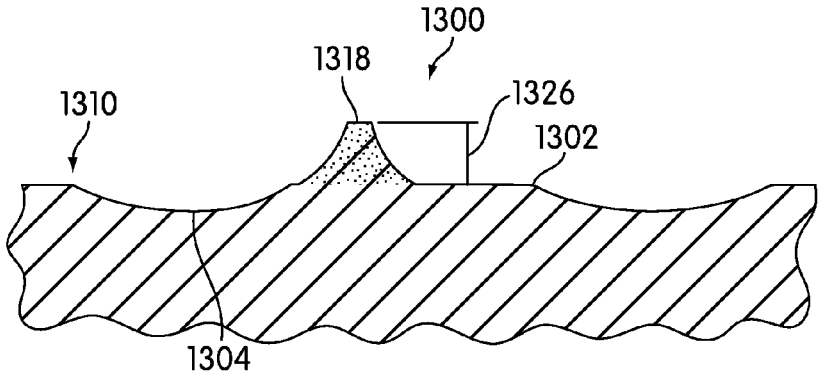
FIG. 28 is a partial cross sectional view of the embodiment of the projection of FIG. 27 taken along line 28-28 of FIG. 27.
Figure 29:
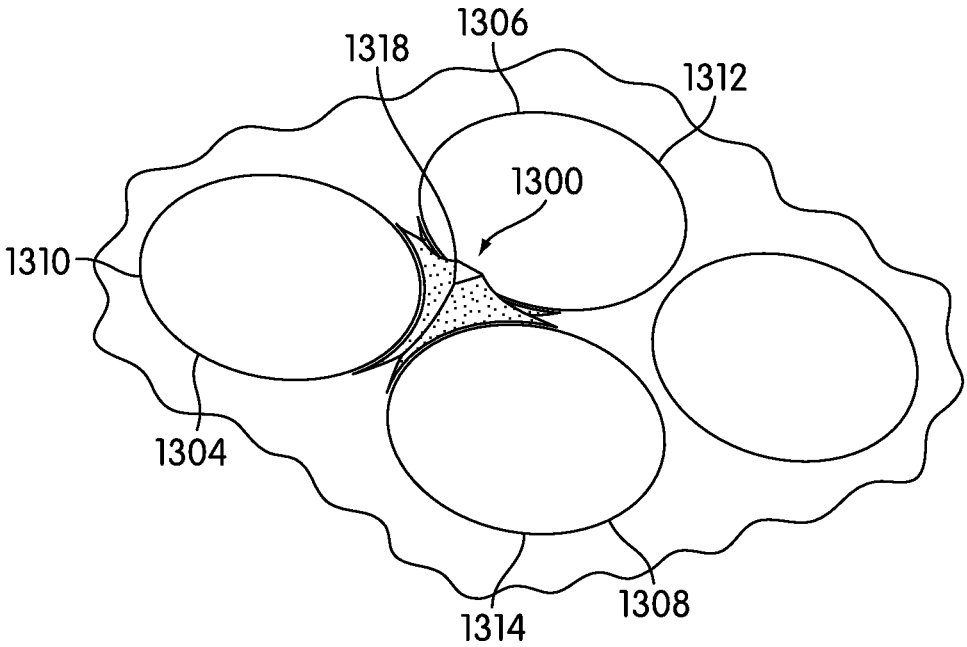
FIG. 29 is an isometric view of the embodiment of the projection of FIG. 27.

Turning now to FIGS. 27-29, an alternative embodiment of a projection is shown. The projection 1300 is positioned on a land section 1302. First dimple 1304, second dimple 1306, and third dimple 1308 are adjacent one another and abut the land section 1302. As shown most clearly in FIG. 28, the projection 1300 may be discontinuous from the first edge or rim 1310 of first dimple 1304, but still projects upwardly to an upper surface 1318. While not detailed in cross sectional views, the projection also may be discontinuous from the second edge 1312 of second abutting dimple 1306 and third edge 1314 of third abutting dimple 1308. In such an embodiment, the first rim 1310, the second rim 1312, and the third rim 1314 are configured in substantially the same manner on the ball as if there were not projection 1300 adjacent the first dimple 1304, second dimple 1306, and third dimple 1308. Each of the first side 1320, second side 1322, and third side 1324 extends laterally at least a portion of the circumference or rim of a corresponding first dimple 1304, second dimple 1306, and third dimple 1308. Each of the first side 1320, second side 1322, and third side 1324 extends upwardly to an upper surface 1318. The upper surface 1318 of the projection 1300 is positioned above the level of the land 1302 by a height 1326. In this embodiment, the upper surface 1318 is triangular.

Figure 30:
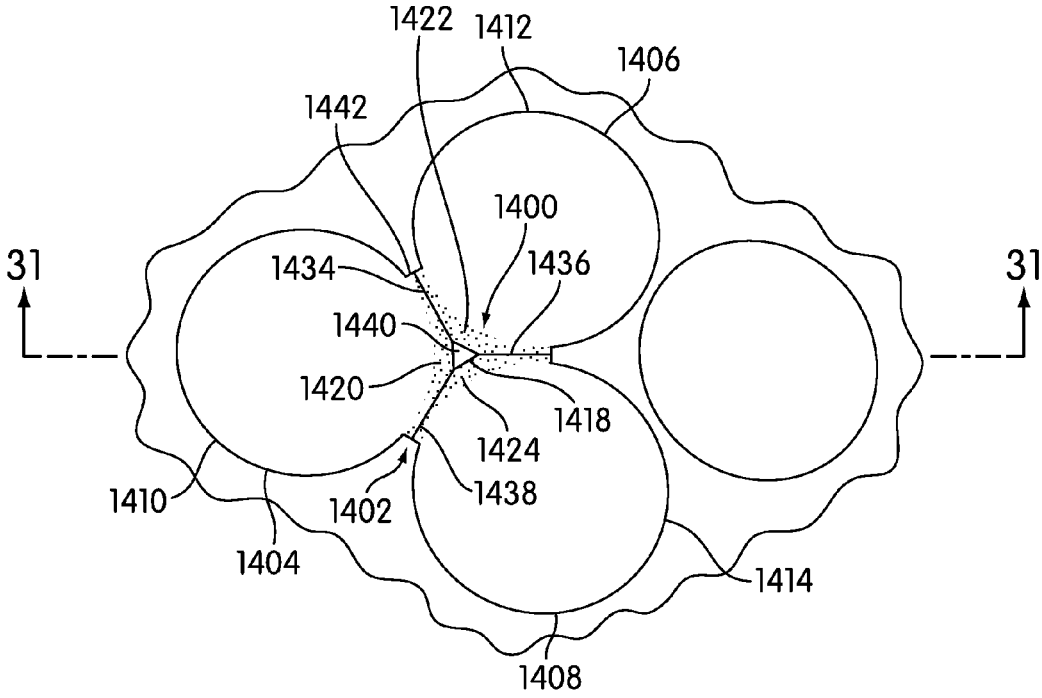
FIG. 30 is a top view of an alternative embodiment of a projection.
Figure 31:
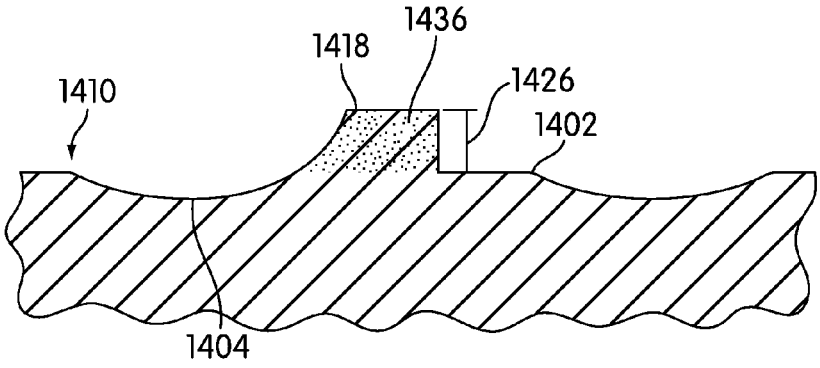
FIG. 31 is a partial cross sectional view of the embodiment of the projection of FIG. 30 taken along line 31-31 of FIG. 30.
Figure 32:
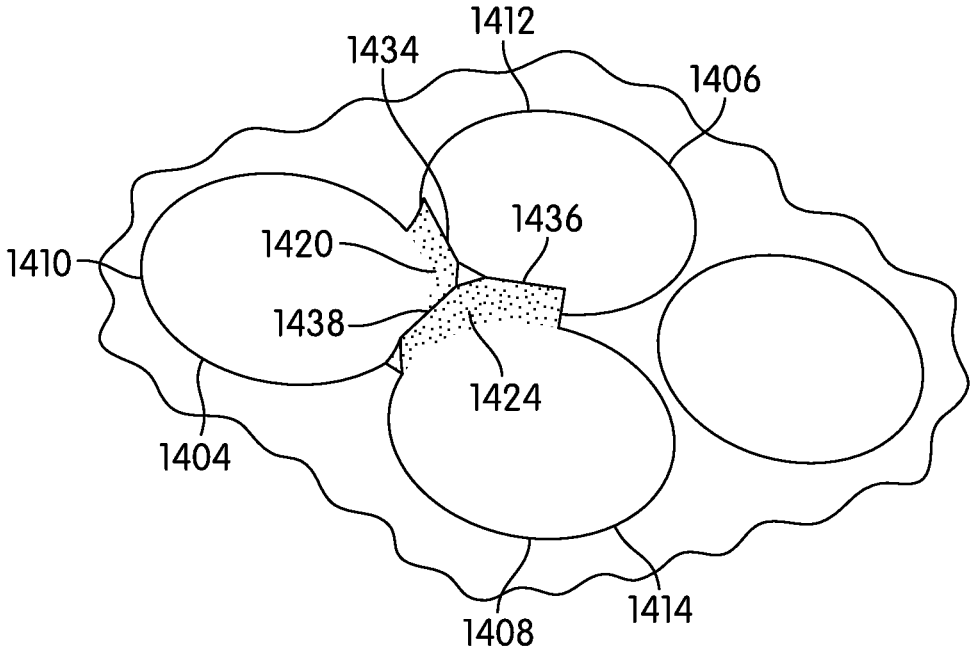
FIG. 32 is an isometric view of the embodiment of the projection of FIG. 30.

Turning now to FIGS. 30-32, an alternative embodiment of a projection is shown. The projection 1400 is positioned on a land section 1402. First dimple 1404, second dimple 1406, and third dimple 1408 are adjacent one another and abut the land section 1402. As shown most clearly in FIG. 31, the projection 1400 extends continuously or as a continuous surface from the first edge or rim 1410 of first dimple 1404 to an upper surface 1418. While not detailed in cross sectional views, the projection also extends continuously from the second edge 1412 of second abutting dimple 1406 and third edge 1414 of third abutting dimple 1408. The stippling in FIGS. 30 and 32 on the first side 1420, second side 1422, and third side 1424 of the projection 1400 is provided as a visual aid to more clearly see the side of the projection, but does not represent a discontinuity or any additional surface feature. Each of the first side 1420, second side 1422, and third side 1424 extends laterally at least a portion of the circumference or rim of a corresponding first dimple 1404, second dimple 1406, and third dimple 1408. Each of the first side 1420, second side 1422, and third side 1424 extends upwardly to an upper surface 1418. The upper surface 1418 of the projection 1400 is positioned above the level of the land 1402 by a height 1426. In this embodiment, the upper surface 1418 is triangular.

The projection 1400 includes first arm 1434, second arm 1436, and third arm 1438. As noted above, the projection 1400 may be formed such that each of the first side 1420, second side 1422, and third side 1424 of the projection 1400 is formed in a continuous curve from the bottom of a corresponding first dimple 1404, second dimple 1406, and third dimple 1408. Where two of the corresponding walls meet is formed a corresponding arm. For example, at the location where wall 1420 and wall 1422 meet is positioned arm 1434. The length of any particular arm, such as arm 1434, is variable. The length of arm 1434 may be the distance from the center 1440 of the projection 1400 to a point 1442 that is the position where two corresponding dimples, in this case first dimple 1404 and second dimple 1406, reach their closest point in the absence of a projection. In many cases, it may be desirable to allow the height of the arm to taper or decrease from a maximum height that equals the height 1426 of the projection 1400 to a minimum height of zero, or to the height of the land. As shown in FIGS. 30-32, however, it may also be desirable if first arm 1434, second arm 1436, and third arm 1438 each have a high substantially the same as the height 1426 of the projection 1400. Due to manufacturing conditions and material selection, the height 1426 may vary slightly along a length of each arm.

Figure 33:
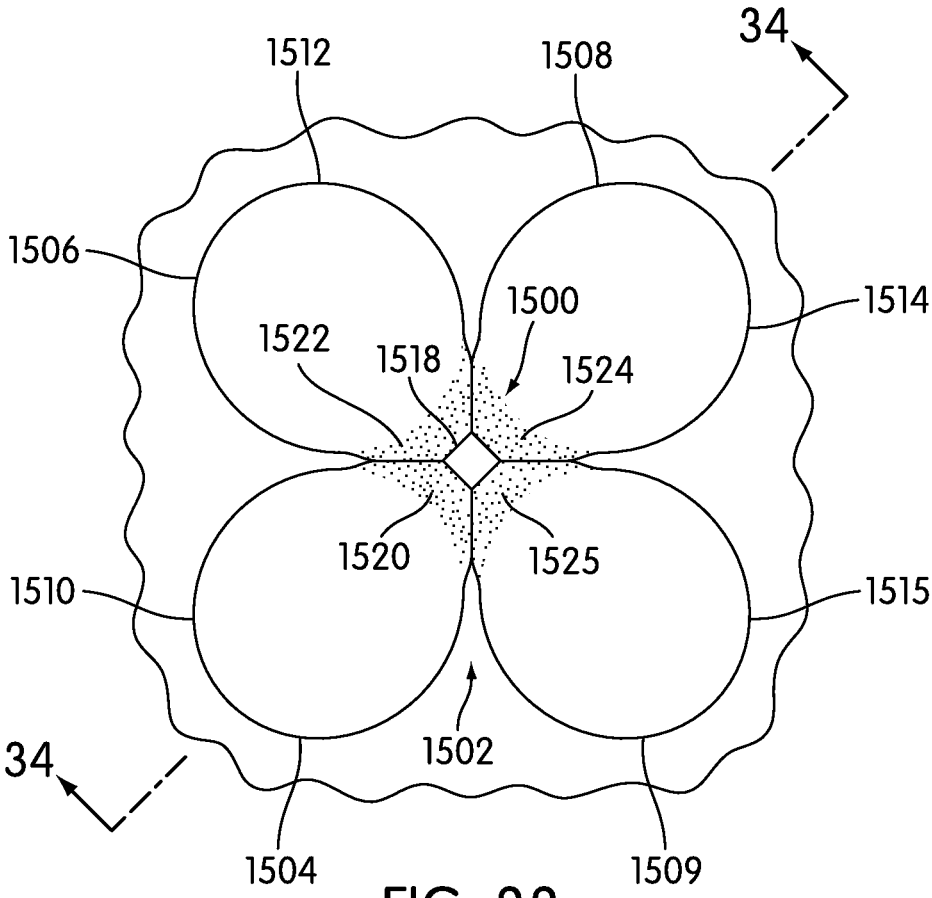
FIG. 33 is a top view of an alternative embodiment of a projection.
Figure 34:
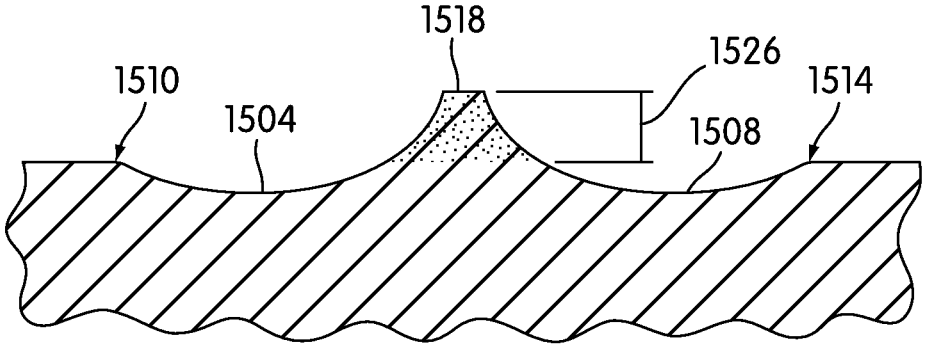
FIG. 34 is a partial cross sectional view of the embodiment of the projection of FIG. 33 taken along line 34-34 of FIG. 33.
Figure 35:
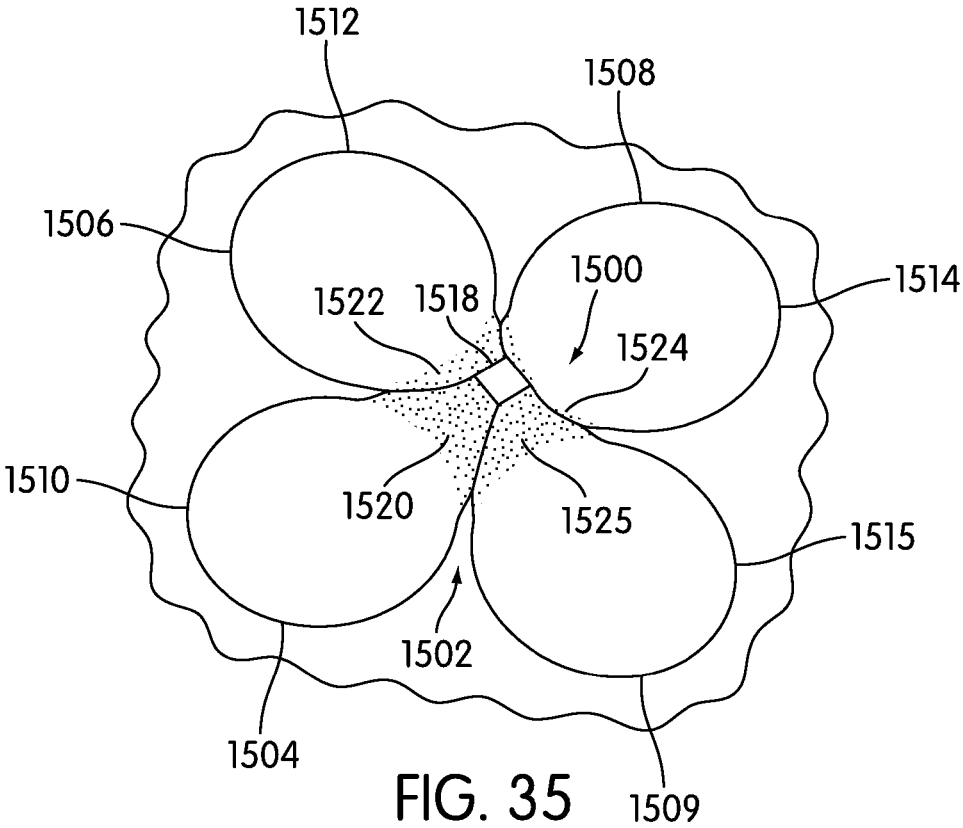
FIG. 35 is an isometric view of the embodiment of the projection of FIG. 33.

Turning now to FIGS. 33-35, an alternative embodiment of a projection is shown. The projection 1500 is positioned on a land section 1502. First dimple 1504, second dimple 1506, third dimple 1508, and fourth dimple 1509 are adjacent one another and abut the land section 1502. As shown most clearly in FIG. 34, the projection 1500 extends continuously or as a continuous surface from the first edge or rim 1510 of first dimple 1504 and from the third edge or rim 1514 of third dimple 1508 to an upper surface 1518. While not detailed in cross sectional views, the projection also extends continuously from the second edge 1512 of second abutting dimple 1506 and fourth edge 1515 of fourth abutting dimple 1408. The stippling in FIGS. 33 and 35 on the first side 1520, second side 1522, third side 1524, and fourth side 1525 of the projection 1500 is provided as a visual aid to more clearly see the side of the projection, but does not represent a discontinuity or any additional surface feature. Each of the first side 1520, second side 1522, and third side 1524 extends laterally at least a portion of the circumference or rim of a corresponding first dimple 1504, second dimple 1506, and third dimple 1508. Each of the first side 1520, second side 1522, and third side 1524 extends upwardly to an upper surface 1518. The upper surface 1518 of the projection 1500 is positioned above the level of the land 1502 by a height 1526. In this embodiment, the upper surface 1518 is square.

Figure 36:
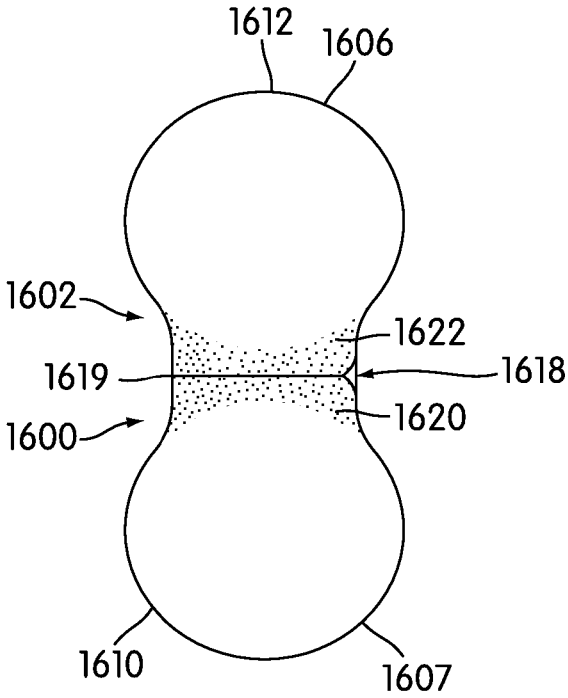
FIG. 36 is a top view of an alternative embodiment of a projection.

Turning now to FIG. 36, an alternative embodiment of a projection is shown. The projection 1600 is positioned on a land section 1602. First dimple 1604 and second dimple 1606 are adjacent one another and abut the land section 1602. The projection 1600 extends continuously or as a continuous surface from the first edge or rim 1610 of first dimple 1604 to an upper surface 1618. The projection also extends continuously from the second edge 1612 of second abutting dimple 1606. The stippling in FIG. 36 on the first side 1620 and second side 1622 of the projection 1600 is provided as a visual aid to more clearly see the side of the projection, but does not represent a discontinuity or any additional surface feature. Each of the first side 1620 and second side 1622 extends laterally at least a portion of the circumference or rim of a corresponding first dimple 1604 or second dimple 1606. Each of the first side 1620, second side 1622, and third side 1624 extends upwardly to an upper surface 1618. The upper surface 1618 of the projection 1600 is positioned above the level of the land 1402 by a height. In this embodiment, the upper surface 1618 is triangular. In this embodiment, there is a second upper surface 1619. The second upper surface 1619 may be of the same shape and size as first upper surface 1618 or may be of a different shape and size. In FIG. 36, second upper surface 1619 is shown as being a point.

A person having ordinary skill in the art will be able to select the appropriate characteristics disclosed to produce a desired flight path of a ball. Many of the characteristics disclosed in the embodiment may be selected individually. For example, the varying embodiments disclose that a projection may be positioned on a land section. Any of the projections disclosed may be positioned on any land section and may abut any number of dimples. Any of the projections disclosed may be positioned on and extend from at least two adjacent dimples that abut a vertex section of the land. Such a projection may be considered a vertex projection. Any of the projections disclosed may be positioned on and extend from at least two adjacent dimples that abut a center section of land. Such a projection may be considered a center projection.

A person having ordinary skill in the art may select from any of a variety of shapes of upper surface for a projection. While several shapes of upper projection are disclosed, these shapes do not form the entire universe of shapes that may be selected, but instead are exemplary of shapes that may be selected.

A person having ordinary skill in the art may select from a variety of heights of arms. Varying types of heights of arms are disclosed. However, these tapers do not form the entire universe of taper angles that are available to be used, but instead are exemplary of the tapers that may be selected.

A person having ordinary skill in the art may select from a variety of lengths and configurations of arms and arm extensions. While several configurations were disclosed, these configurations do not form the entire universe of configurations that may be selected, but instead are exemplary of the configurations that may be selected.

A person having ordinary skill in the art can easily make a selection from each of these categories, as well as others that are not specifically disclosed, to configure a ball that has the flight path characteristics that the designer desires.

In addition, when positioning the projections on the ball, a person having ordinary skill in the art may select from varying types of spacing. The person having ordinary skill in the art will be aware of configurations of projections that will yield a spherically symmetrical ball and which configurations of projections will yield a ball that does not have spherical symmetry. The person having ordinary skill in the art can decide which type of design to create.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A golf ball, comprising:

an outer surface, including a plurality of dimples and a land, wherein the dimples are arranged to form at least one shaped region having a center disposed in a first area between dimples; and a center projection having opposing sides respectively extending from edges of at least two adjacent dimples that abut the first area;

wherein the center projection has an upper surface above the land.

2. The golf ball of claim 1, wherein the at least one shaped region is a polygonal region having a plurality of vertices.

3. The golf ball of claim 2, further including a plurality of vertex projections;

wherein each of the vertex projections is located in an area between dimples and at a corresponding vertex of the shaped region and extends from edges of at least two adjacent dimples;

each vertex projection having an upper surface above the land.

4. The golf ball according to claim 3, wherein each of the plurality of vertex projections extends from edges of at least three adjacent dimples;

each vertex projection having an upper surface above the land.

5. The golf ball according to claim 4, wherein each projection extends from only a portion of the edge of each adjacent dimple.

6. The golf ball according to claim 1, wherein the dimples are arranged in a plurality of shaped regions; and wherein each of the shaped regions includes a center and a center projection extending in the center of the respective shaped region from edges of at least two adjacent dimples;

each center projection having an upper surface above the land.

7. The golf ball according to claim 6, wherein each projection extending in the center of a respective shaped region extends from only a portion of the edge of each adjacent dimple.

8. The golf ball according to claim 1, wherein the ball is spherically symmetrical.

9. The golf ball according to claim 1, wherein the center projection extends from edges of at least three adjacent dimples.

10. The golf ball according to claim 1, wherein the center projection extends from only a portion of the edge of each adjacent dimple.

11. A golf ball, comprising:

an outer surface, including a plurality of dimples and a land, wherein the dimples are arranged in at least one polygonal region, the at least one polygonal region having a plurality of vertices, each of the vertices being located between dimples; and a plurality of vertex projections, each vertex projection having opposing sides respectively extending from edges of at least two adjacent dimples and being located about at a corresponding vertex of the polygonal region, each vertex projection having an upper surface above the land.

12. The golf ball according to claim 11, wherein each vertex projection extends from edges of at least three adjacent dimples.

13. The golf ball according to claim 12, wherein the projection extends from only a portion of the edge of each adjacent dimple.

14. The golf ball according to claim 11, wherein the ball is spherically symmetrical.

15. The golf ball according to claim 11, wherein the dimples are arranged in a plurality of polygonal regions;

the ball further including additional vertex projections at vertices of the plurality of polygonal regions, each of the additional vertex projections extending from edges of at least two adjacent dimples;

each of the additional vertex projections having an upper surface above the land.

16. A golf ball, comprising:

an outer surface including a land and dimples; and a projection positioned between at least two adjacent dimples, the projection comprising:

at least two sides, each side extending from about an edge of a corresponding dimple, a first side extending a portion of the distance around a first circumference of a first dimple and a second side extending a portion of the distance around a second circumference of a second dimple, and where the sides also extend upwardly to an upper surface above the land.

17. The golf ball according to claim 16, wherein at least a first portion of the first side extends upwardly to meet a second portion of a second side at an arm.

18. The golf ball according to claim 17, wherein the arm extends from the upper surface to a point corresponding to the position where the first dimple and the second dimple are closest to one another.

19. The golf ball according to claim 18, wherein the arm tapers from a height substantially the same as the height of the upper surface to the land.

20. The golf ball according to claim 16, wherein the projection is of a shape and size sufficient to alter a flight path of a ball.

* * * * *